US005534987A

United States Patent [19]

Ohtsuka et al.

[11] Patent Number: 5,534,987

[45] Date of Patent: Jul. 9, 1996

[54] FIXING APPARATUS WITH VARIABLE FIXING TEMPERATURE

[75] Inventors: Yasumasa Ohtsuka; Shunji Nakamura, both of Yokohama; Takashi Soya, Kawasaki; Kouichi Okuda, Yokohama; Yohji Tomoyuki, Ichikawa; Akira Hayakawa, Tokyo; Manabu Takano, Tokyo; Daizo Fukuzawa, Tokyo; Hidenobu Suzuki, Kawasaki; Atsuyoshi Abe, Yokohama, all of Japan

[73] Assignee: Canon Kabushiki Kaisha, Tokyo, Japan

[21] Appl. No.: 508,416

[22] Filed: Jul. 28, 1995

Related U.S. Application Data

[63] Continuation of Ser. No. 196,456, Feb. 15, 1994, abandoned.

[30] Foreign Application Priority Data

Feb. 16, 1993 [JP] Japan ..... 5-026809

[51] Int. Cl.[6] ..... G03G 15/20

[52] U.S. Cl. ..... 355/285; 219/216

[58] Field of Search ..... 355/203, 208, 355/282, 285, 290; 219/216, 469, 470; 432/60

[56] References Cited

U.S. PATENT DOCUMENTS

| | | | |
|---|---|---|---|
| 4,868,368 | 9/1989 | Araki | 219/216 |
| 5,253,024 | 10/1993 | Okuda et al. | 355/282 |
| 5,266,774 | 11/1993 | Kimura et al. | 219/216 |
| 5,280,328 | 1/1994 | Goto et al. | 355/285 |
| 5,293,202 | 3/1994 | Adachi et al. | 355/282 |
| 5,321,481 | 6/1994 | Mathers | 355/290 |

FOREIGN PATENT DOCUMENTS

| | | |
|---|---|---|
| 222120 | 5/1987 | European Pat. Off. . |
| 436955 | 7/1991 | European Pat. Off. . |
| 523638 | 1/1993 | European Pat. Off. . |
| 57-70575 | 5/1982 | Japan . |

OTHER PUBLICATIONS

European Search Report.
French Search Report.

*Primary Examiner*—William J. Royer
*Attorney, Agent, or Firm*—Fitzpatrick, Cella, Harper & Scinto

[57] ABSTRACT

A fixing apparatus includes a heating member; a temperature detecting member for detecting the temperature of the heating member; a power supply controller for controlling the power supply to the heating member so that the temperature detected by the temperature detecting element during a fixing operation is maintained substantially constant at a predetermined fixing temperature; and a temperature selecting device for selecting a fixing temperature in response to both the temperature of the heating member before beginning of the fixing temperature control and a rate of the temperature change of the heating member upon supplying a predetermined amount of power to the heating member or upon turning it off.

9 Claims, 6 Drawing Sheets

| TEMP. $T_1$ IMMEDIATELY BEFORE OPERATION | CONT. TEMP $T_c$ DURING OPERATION |
|---|---|
| 70°C OR HIGHER | 170°C |
| 50°C - 70°C | 180°C |
| 50°C OR LOWER | 190°C |

FIXING APPARATUS WITH VARIABLE FIXING TEMPERATURE

This application is a continuation of application Ser. No. 08/196,456, filed Feb. 15, 1994, now abandoned.

FIELD OF THE INVENTION AND RELATED ART

The present invention relates to a fixing apparatus for fixing thermally an image carried on a recording material, in particular to a fixing apparatus in which the power supply to a heater is stopped while the apparatus is on standby.

In the past, a heat roller system as shown in FIG. 2 has been widely in use as the fixing system for fixing thermally a toner image onto the recording material.

In this system, a fixing roller 9 comprising a metallic core made of aluminum or the like material and a heat resistant separating layer made of PFA or the like is heated from within by a heater 10. The temperature of the fixing roller 9 is read by a temperature detecting element 13 placed in contact with the surface of the fixing roller and is sent to an unshown control circuit, which turns on or off the heater 10 so that the fixing roller temperature is maintained at a predetermined one. The fixing roller 9 forms a nip in cooperation with a pressure roller 2, and through this nip, a sheet of paper P carrying a toner image T is passed, whereby the toner image T is fused to the sheet of paper P; in other words, it is fixed.

However, in this system, the temperature of the fixing roller 9 had to be kept high even during the standby period, for it took a relatively long time for the heat from the heater 10 to reach the fixing roller surface.

Therefore, in order to minimize the warmup time as well as to save entirely the power consumed during the standby period or reduce it to a minimum, a fixing apparatus of a different type has been devised, which comprise a heater, which has an extremely small thermal capacity and whose temperature quickly rises, and a film which slides on this heater.

In such an apparatus in which the high temperature is not under control during the standby period, the fixing performance is greatly affected by the apparatus temperature at the time when the fixing operation begins; for example, the high temperature offset is caused by the toner melted excessively, or on the contrary, under fixation is caused by the lack of heat.

Therefore, another type of fixing apparatus, disclosed in U.S. patent Ser. No. 636,241, has been devised, in which a different fixing temperature was selected depending on the apparatus temperature.

This type of apparatus, however, has such a problem that when the printing operation is intermittently carried out, the apparatus temperature cannot be accurately known. For example, the heat roller temperature detected by the temperature detecting element after the apparatus is stopped varies depending on the apparatus temperature, as shown by the heat radiation curves in FIG. 5. A solid line (1) represents a case of a cold apparatus, and a broken line (2) and a single dot chain line (3) represent cases of warm and warmer apparatuses, respectively. The difference among these three curves was not detected in the prior apparatus; therefore, the target fixing temperature was selected based on only the heat roller temperature of that moment. As a result, when the printing operation was restarted before the heat had completely radiated, a high temperature was sometimes selected as the target fixing temperature in spite of the fact that the apparatus was warm, causing thereby a hot offset, and other times, a low temperature was selected in spite of the fact that the apparatus had cooled down, causing thereby under fixation.

SUMMARY OF THE INVENTION

Accordingly, a primary object of the present invention is to provide a fixing apparatus in which an accurate fixing temperature can be selected regardless of the level of the heat radiation from the apparatus.

According to an aspect of the present invention, the fixing apparatus comprises: a heating member; a temperature detecting member for detecting the temperature of said heating member; power supply controlling means for controlling the power supply to said heating member so that the temperature detected by said temperature detecting element during a fixing operation is maintained constant at a predetermined fixing temperature; and temperature selecting means for selecting a fixing temperature in response to both the temperature of said heating member obtained before the beginning of the fixing temperature control, and the rate of the temperature change of said heating member obtained by supplying a predetermined amount of power to said heating member or by turning it off.

These and other objectives, features and advantages of the present invention will become more apparent upon a consideration of the following description of the preferred embodiments of the present invention taken in conjunction with the accompanying drawings.

DESCRIPTION OF THE PREFERRED EMBODIMENTS

Figure 1:
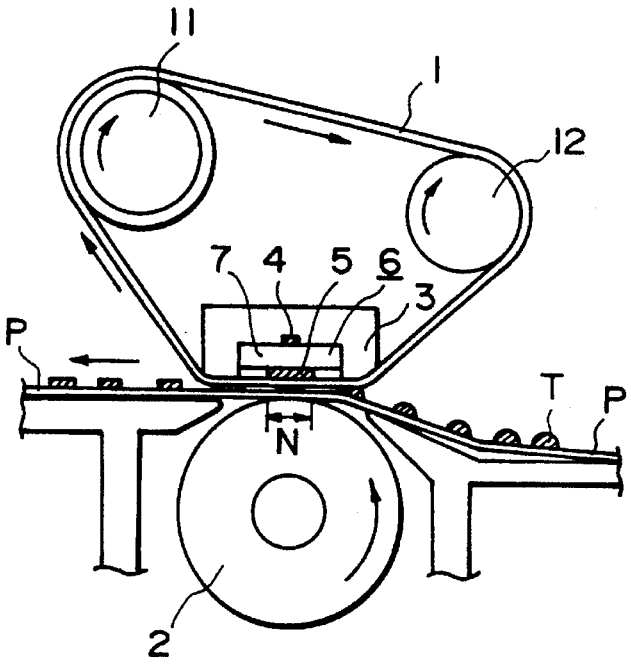
FIG. 1 is a sectional view of a preferred embodiment of the fixing apparatus according to the present invention
Figure 2:
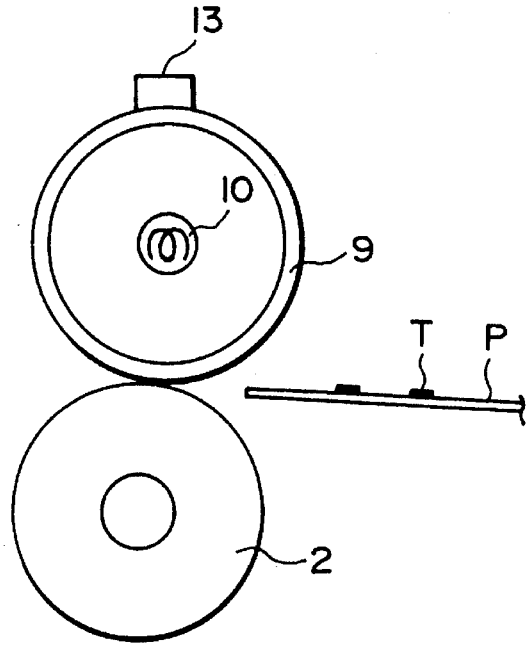
FIG. 2 PRIOR ART
FIG. 2 is a sectional view of a prior heating apparatus of a roller type.

FIG. 1 is a sectional view of a preferred embodiment of the fixing apparatus according to the present invention.

In FIG. 1, a reference numeral 1 designates a fixing film comprising a base film of heat resistant resin such as polyimide, and a separative layer of heat resistant material such as FFA or PTFE coated on the base film.

A reference numeral 6 designates a heating member comprising a thermally conductive and heat resistant substrate of aluminum or the like and an exothermic resistor 5 printed in a pattern on the substrate. To the back surface of the heating member 6, a temperature sensor 4 is adhered. A reference numeral 3 designates a stay made of thermally insulating resin, and it holds the heating member 6 and guides the sliding film.

A reference numeral 11 designates a roller for driving the fixing film 1 from within, and. 12 designates a tension roller for giving tension to the fixing film 1 in order to prevent the fixing film 1 from shifting. The film 1 is driven in the direction indicated by an arrow.

A recording material P carrying an unfixed toner image T is introduced into a nip formed with pressure roller 2, where the toner image is heated and compressed to be permanently fixed to the material P, and then, the material P now carrying a fixed image is discharged from the nip.

As soon as an image formation signal is inputted, the power supply to the heating member 6 is started, wherein the power supply to the heating member 6 is controlled so as for the temperature detected by the temperature sensor to be maintained at a predetermined one.

After the completion of the fixing operation, the power supply to the heating member 6 is stopped unless the next image formation signal has been inputted.

First, a method (Method 1) used with the aforementioned structure will be described, in which a target temperature $T_c$ is selected in response to a temperature $T_1$ detected by the temperature sensor 4 immediately before the actual fixing operation is started.

Figures 3, 4:
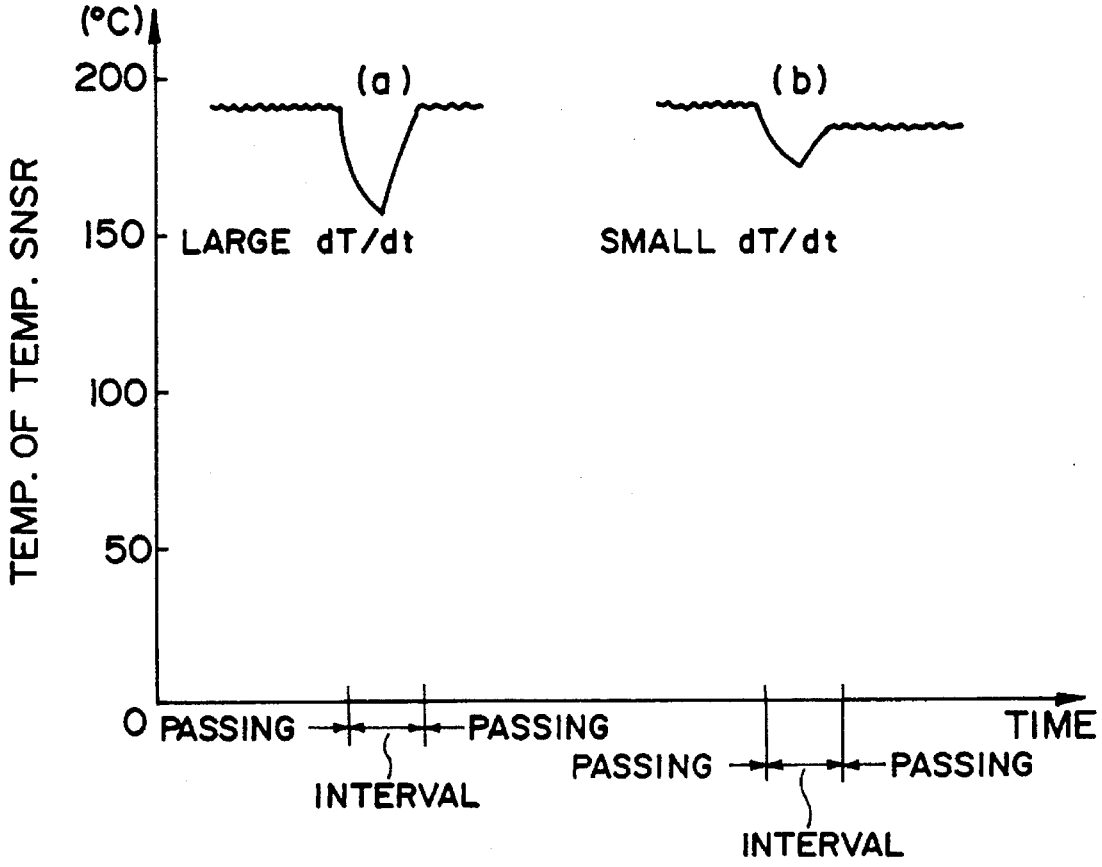
FIG. 3 is a graph showing the relation between the temperature immediately before the start of the operation and the target temperature for the fixing operation.
FIG. 4 is a control diagram for switching the fixing temperature during a continuous operation in the apparatus of this embodiment.

FIG. 3 shows an example in which the temperature $T_1$ detected by the temperature sensor is classified into one of three temperature levels, to each of which a different fixing temperature $T_c$ is assigned.

According to this table, when the detected temperature $T_1$ is no more than 50° C., the apparatus is determined to have cooled down, and a temperature of 190° C., a rather high temperature, is selected as the fixing temperature.

On the contrary, when the detected temperature $T_1$ is no less than 70° C., the apparatus is determined to be relatively warm, and a temperature of 170° C. is selected as the fixing temperature.

Next, a method for selecting the fixing temperature during the continuous printing operation will be described.

The fixing temperature needs to be switched even during the continuous printing operation, depending on how warm the apparatus is. This is because the heat is also transmitted to the recording material from the pressure roller as the apparatus becomes warmer; therefore, the target temperature to which the heater is heated must be gradually decreased in order to keep constant the amount of overall heat given to the recording material.

If the temperature of the heat roller is not reduced, an excessive amount of heat is given to the recording material, over-melting the toner; as a result, hot offset is caused.

As for a means for judging when the fixing temperature is to be switched during the continuous printing operation, the heater is turned of during the sheet interval or during the post rotation period, and then, the temperature of the heat roller is detected by the temperature sensor to determine the rate of temperature change dT/df, based on which the apparatus temperature is judged; in other words, the fixing temperature can be selected in response to this rate of the temperature change.

Referring to FIG. 4, when the apparatus has cooled down, the value of dT/df obtained by turning off the heater during the sheet interval becomes larger, as shown by (a), than a predetermined reference value; therefore, the temperature control is carried out without changing the target temperature.

On the other hand, when the value of dT/df is smaller, as shown by (b), than the reference value, the apparatus is judged to be warm; therefore, the target temperature is lowered.

Figure 8:
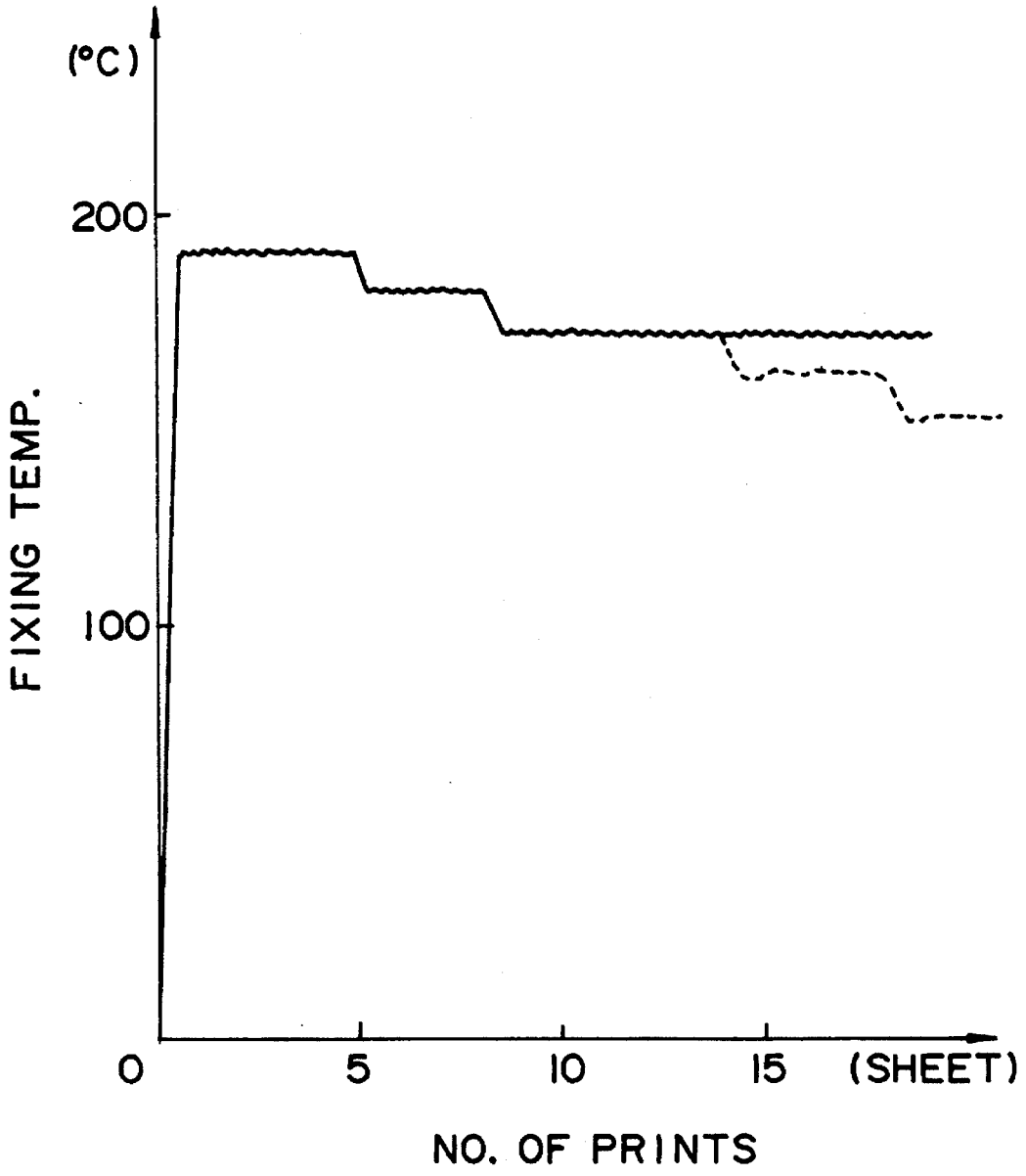
FIG. 8 is a control diagram for switching the fixing temperature in the apparatus according to the present invention, during continuous operation.

When the temperature control is executed in this manner during the continuous printing operation, the fixing temperature is decreased step by step, as indicated by the solid line in FIG. 8. When the continuous printing operation during which the fixing temperature is changed in this manner is completed or interrupted, a target temperature $T_2$ is stored, which is selected in response to the rate of temperature change dT/df while the last print before the interruption is made.

A method in which this target temperature $T_2$ is used as the fixing temperature for the restarted printing operation is called Method 2.

In this embodiment, two fixing temperatures $T_1$ and $T_2$ selected in Method 1 and Method 2, respectively, are compared, and the temperature with a higher value is elected as the fixing temperature for the restarted printing operation.

Figure 5:
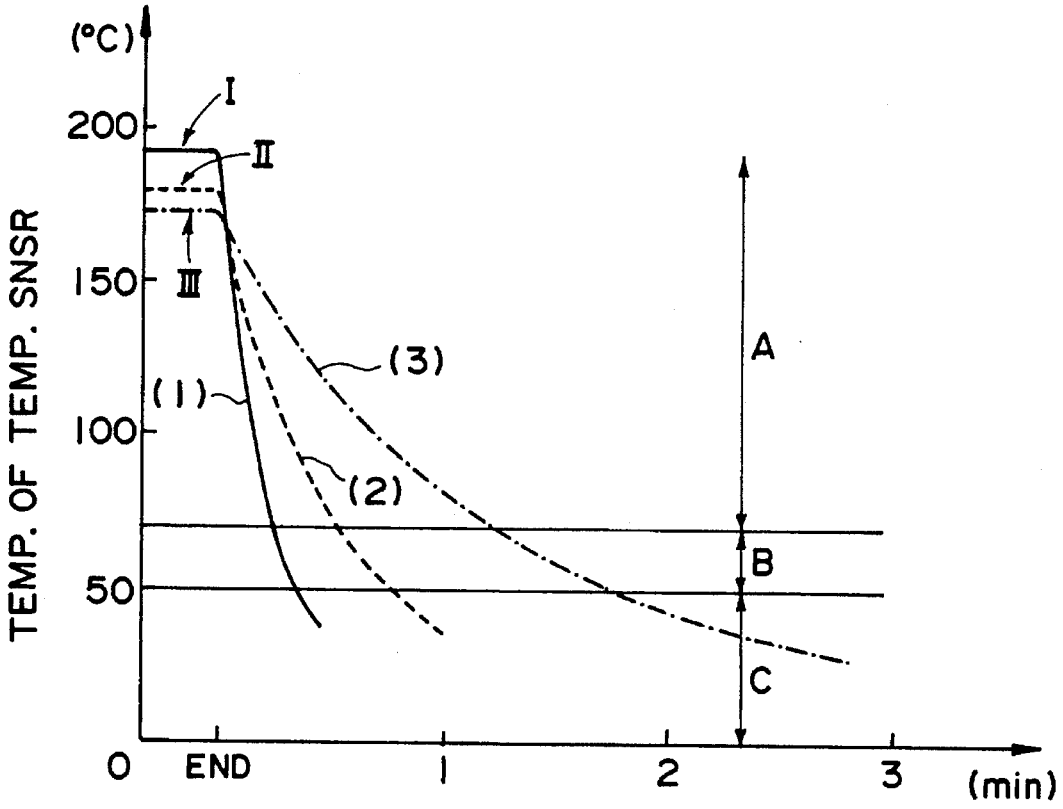
FIG. 5 is a graph showing the decline of the temperature detected by the temperature sensor in the apparatus of this embodiment after the completion of the operation.
Figure 6:
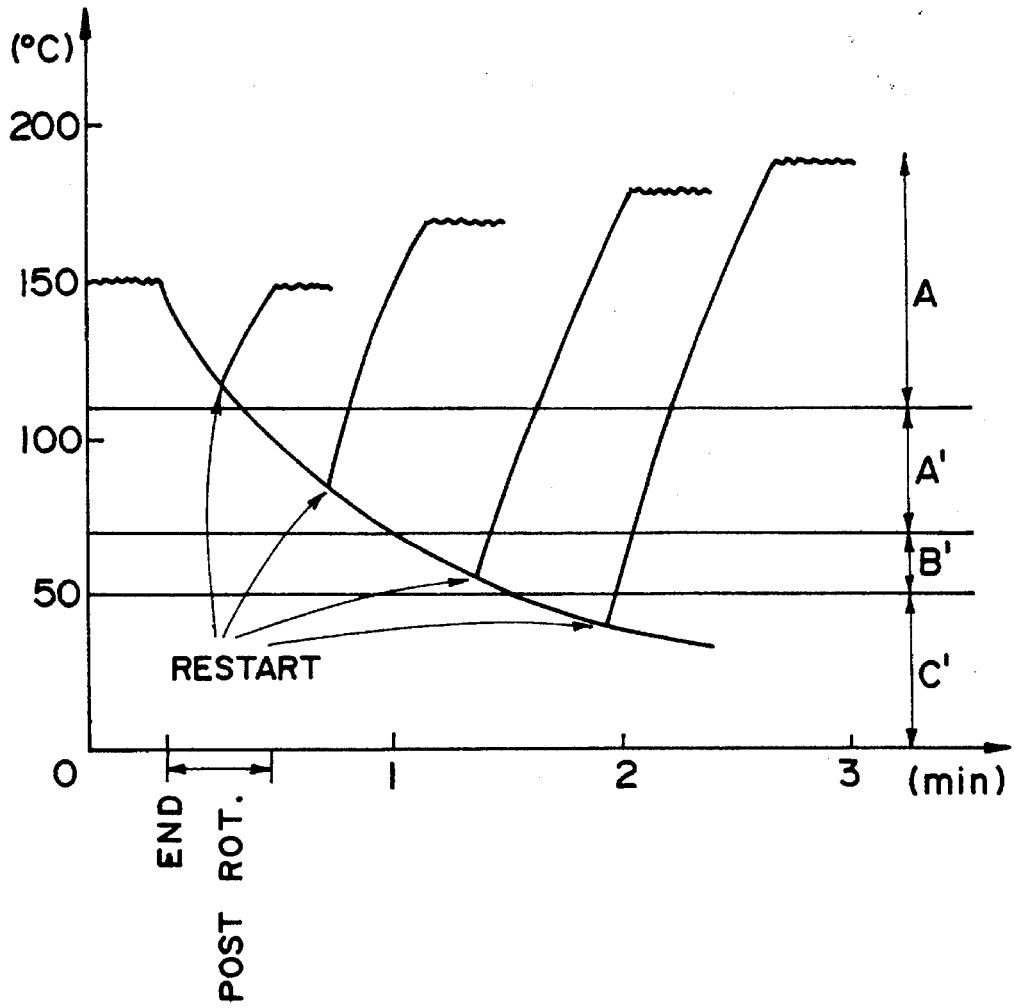
FIG. 6 is a control diagram of the first embodiment of the present invention.

Referring to FIG. 5, a more specific description will be given.

In the case of (1), in which the apparatus has not warmed up, dT/df obtained by turning off the heater during the sheet interval before the printing operation is stopped is larger, and the target temperature is set at 190° C., being relatively high. In this case, $T_2$=190° C. is stored as the fixing temperature selected by Method 2, and whenever the printing operation is restarted while the heat is still radiating, a temperature of 190° C. is selected as the fixing temperature. In this embodiment, the fixing temperature is selected in response to the level of the thermal state of the apparatus detected by the temperature detecting element, as shown in Table 1.

TABLE 1

| Detected temp. | Method 1 $T_1$ | Method 2 $R_2$ | Fixing temp. Tc = MAX ($T_1$, $T_2$) |
|---|---|---|---|
| ≧70 ° C. | 170° C. | 190° C. | 190° C. |
| ≧50 < 70° C. | 180 | 190 | 190 |
| <50° C. | 190 | 190 | 190 |

When the apparatus has cooled down as shown, a relatively high fixing temperature is selected regardless of the initial temperature of the heating member in order to prevent under fixation.

When the fixing apparatus is slightly warm as indicated by the broken line (2), $T_2$ =180° C. is stored; therefore, the target fixing temperature $T_c$ for the printing operation restarted while the heat is still being radiated is selected as shown in the following Table 2.

TABLE 2

| Detected temp. | Method 1 $T_1$ | Method 2 $R_2$ | Fixing temp. Tc = MAX ($T_1$, $T_2$) |
|---|---|---|---|
| ≧70 ° C. | 170° C. | 180° C. | 180° C. |
| ≧50 < 70° C. | 180 | 180 | 180 |
| <50° C. | 190 | 180 | 190 |

When the apparatus is sufficiently warm as shown by the single dot chain line, $T_2$=170° C. is stored; therefore, the target fixing temperature for the printing operation restarted while the heat is still radiating is selected as shown by the following Table 3.

TABLE 3

| Detected temp. | Method 1 $T_1$ | Method 2 $R_2$ | Fixing temp. $Tc = MAX (T_1, T_2)$ |
|---|---|---|---|
| ≧70 ° C. | 170° C. | 170° C. | 170° C. |
| ≧50 < 70 ° C. | 180 | 170 | 180 |
| <50° C. | 190 | 170 | 190 |

Figure 7:
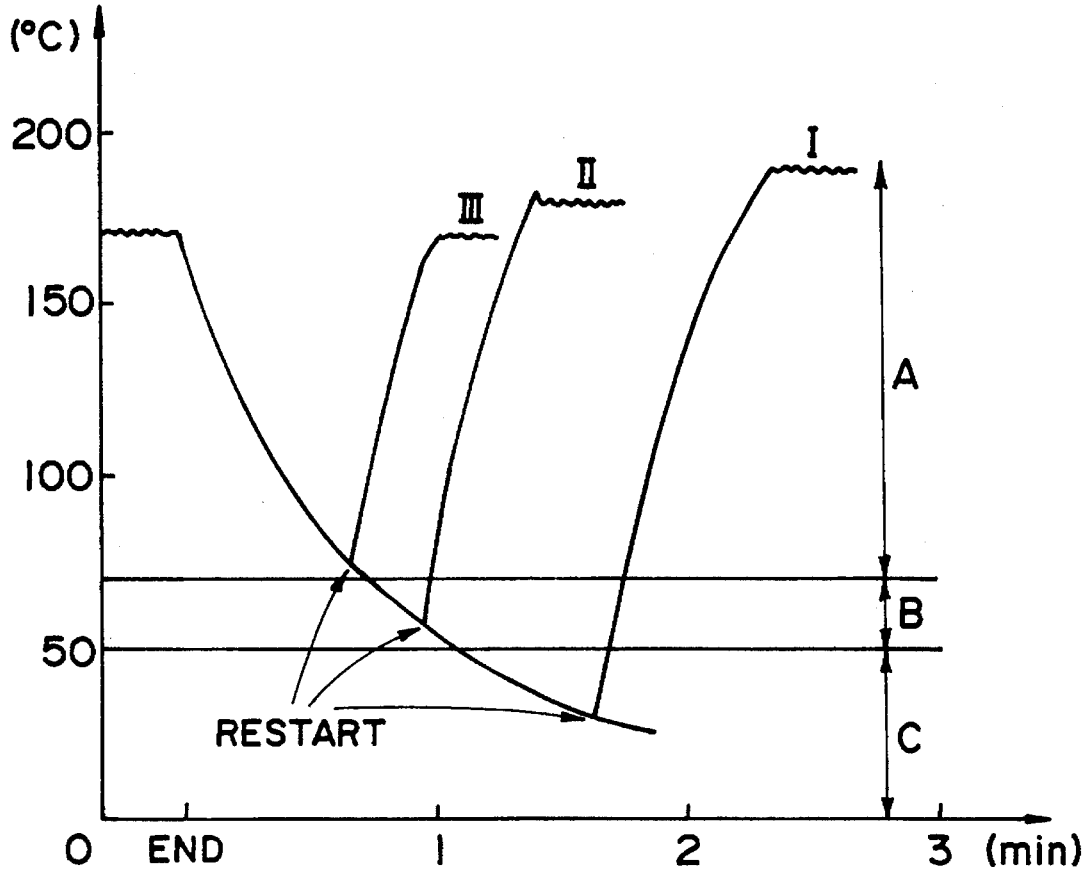
FIG. 7 is a control diagram of the second embodiment of the present invention.

When the control is executed according to this table, the fixing temperature sometimes changes as shown in FIG. 7, depending on the restarting timing.

In other words, when the apparatus is warm, a relatively low fixing temperature is selected to prevent hot offset and when the apparatus has cooled down, a relatively high fixing temperature is selected to prevent under fixation.

In this embodiment, in which the fixing temperature was selected based on the thermal state of the apparatus, both the temperature itself and the rate of its change were detected to determine the thermal state of the apparatus; therefore, it became possible to prevent both under fixation and hot offset.

In addition, the aforementioned effects could be obtained in any type of continuous printing operation.

In this embodiment, the rate of temperature change dT/df was obtained by turning off the power supply to the heater during the sheet interval, but it is needless to say that it may be obtained by turning on the power supply.

Embodiment 2

In the preceding embodiment, the number of temperature levels, according to which the fixing temperature is selected in Method 1, was equal to that selected during the continuous printing operation. However, it is preferable that the number of temperature levels for the continuous printing operation be larger.

For example, referring to the broken line in FIG. 8, five fixing temperatures, 190° C., 180° C., 170° C., 160° C. and 150° C., which are selected depending on the rate of temperature change, are provided, and also, the temperatures detected in Method 1 by the temperature senor are grouped into the temperature levels as shown in the following Table 4.

TABLE 4

| Level | Detected temp. | $T_1$ |
|---|---|---|
| D | ≧110° C. | 150 (°C.) |
| A' | ≧70° C. < 110° C. | 170 |
| B | ≧50° C. < 70° C. | 180 |
| C | <50° C. | 190 |

When this table is combined with the fixing temperature $T_2$ determined by Method 2, the target temperature $T_c$ is selected as shown in the following Table 5.

TABLE 5

| | Method 1 $T_1$ | Method 2 $R_2$ | Fixing temp. $Tc = MAX (T_1, T_2)$ |
|---|---|---|---|
| D | 150° C. | $T_2$ | $T_2$ (one of 5 levels bet. 150–190° C.) |
| A' | 170° C. | $T_2$ | One of 170° C., 180° C., 190° C. |
| B | 180° C. | $T_2$ | 180° C. or 190° C. |
| C | 190° C | $T_2$ | 190° C. |

In the preceding embodiment, when the fixing temperature for the last print before the completion or interruption of the printing operation was 150° C., a temperature between 170° C. and 190° C. was selected as the fixing temperature for the restarted printing operation, but in such a case that the printing operation is restarted immediately after the interruption, the selection of 170° C. sometimes gives an excessive amount of heat. For example, a case in which the printing operation is restarted during the post rotation period after the completion of a printing cycle is one example of such a case. In this case, there is a chance that a slight hot offset may occur even in the preceding embodiment.

In this embodiment, when such a case occurs as described in the foregoing, the fixing temperature $T_2$ selected by Method 2 in which the number of temperature levels are further increased is chosen as the target fixing temperature $T_c$; in other words, control is executed to make the fixing temperature lower than that determined by $T_1$ therefore, the hot offset is entirely prevented.

Further, in Embodiments 1 and 2, the target fixing temperatures were selected in response to the initial temperature of the heating member and its rate of change, respectively, but the target fixing temperature may be selected based on a table produced in advance by combining the initial temperature and its rate of change.

Further, although the embodiments of the present invention were described with reference to the heating apparatus using the through-film heating system, the present invention is not limited to the apparatus of this type, and is applicable to the apparatuses of the heat roller type in which the thickness of the roller is made thinner so that the roller temperature can be quickly raised.

While the invention has been described with reference to the structures disclosed therein, it is not confined to the details set forth and this application is intended to cover such modifications or changes as may come within the purposes of the improvements or the scope of the following claims.

What is claimed is:

1. A fixing apparatus comprising:

a heating member;

a temperature detecting member for detecting the temperature of said heating member;

electric power supply controlling means for controlling an electric power supply to said heating member so that the temperature detected by said temperature detecting member during a fixing operation is maintained substantially constant at a predetermined fixing temperature; and temperature determining means for determining the fixing temperature in response to both the temperature of said heating member before beginning of the electric power supply control during the fixing operation and a rate of the temperature change of said heating member upon supplying a predetermined amount of electric power to said heating member or upon turning it off.

2. A fixing apparatus according to claim 1, wherein said temperature determining means compares the fixing temperature selected in response to the temperature of said heating member obtained before the beginning of the fixing temperature control with the fixing temperature selected in response to the rate of the temperature change, and selects the higher one as an actual fixing temperature.

3. A fixing apparatus according to claim 1, wherein said temperature determining means turns off the electric power supply to said heating member after the completion of the fixing operation, and measures the rate of temperature change at this time.

4. A fixing apparatus according to claim 1, wherein said apparatus further comprises a film moving in contact with said heating member and a pressing member for forming a nip in cooperation with said heating member, with said film being interposed.

5. A fixing apparatus according to claim 1, wherein said electric power supply controlling means turns off the power supply to said heating member during a standby period, regardless of the temperature of said heating member.

6. A fixing apparatus comprising:

a heating member;

a temperature detecting member for detecting the temperature of said heating member;

electric power supply controlling means for controlling an electric power supply to said heating member so that the temperature detected by said temperature detecting member during a fixing operation is maintained at a predetermined fixing temperature; and temperature determining means for determining the fixing temperature in response to both the temperature of said heating member before beginning of the electric power supply control during the fixing operation and the fixing temperature during an immediately previous fixing operation.

7. An apparatus according to claim 6, wherein said temperature determining means compares the fixing temperature selected in response to the temperature of said heating member obtained before the beginning of the fixing operation with the fixing temperature during previous fixing operation, and selects the higher one as an actual fixing temperature.

8. An apparatus according to claim 6, wherein said apparatus further comprises a film moving in contact with said heating member and a pressing member for forming a nip in cooperation with said heating member, with said film being interposed.

9. An apparatus according to claim 6, wherein said electric power supply controlling means turns off the power supply to said heating member during a standby period, regardless of the temperature of said heating member.

* * * * *

UNITED STATES PATENT AND TRADEMARK OFFICE

CERTIFICATE OF CORRECTION

PATENT NO. : 5,534,987
DATED : July 9, 1996
INVENTOR(S) : YASUMASA OHTSUKA, ET AL.

It is certified that error appears in the above-indentified patent and that said Letters Patent is hereby corrected as shown below:

Column 2,
line 67, "FFA" should read --PFA--.
Column 3,
line 3, strate" should read --strate 7--;
line 9, and." should read --and--; and
line 59, "of" should read --off--.
Column 4,
line 23, "elected" should read --selected--.
Column 6,
line 24, "$T_1$" should read --$T_1$;--.

Signed and Sealed this

Fifth Day of November, 1996

*Attest:*

BRUCE LEHMAN

*Attesting Officer*

*Commissioner of Patents and Trademarks*